US007370858B2

(12) United States Patent
Youn

(10) Patent No.: US 7,370,858 B2
(45) Date of Patent: May 13, 2008

(54) APPARATUS FOR AND METHOD OF PREVENTING PAPER DOUBLE FEEDING IN PRINTER

(75) Inventor: Karp-sik Youn, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 656 days.

(21) Appl. No.: 10/606,110

(22) Filed: Jun. 26, 2003

(65) Prior Publication Data

US 2004/0065992 A1 Apr. 8, 2004

(30) Foreign Application Priority Data

Aug. 20, 2002 (KR) ..... 10-2002-0049210

(51) Int. Cl.
*B65H 3/52* (2006.01)

(52) U.S. Cl. ..... 271/121

(58) Field of Classification Search ..... 271/121, 271/124, 167, 146, 137, 104
See application file for complete search history.

(56) References Cited

U.S. PATENT DOCUMENTS 4,349,126 A * 9/1982 Brown ..... 221/112
4,674,736 A * 6/1987 Tsubo ..... 271/122
5,253,854 A * 10/1993 Tanoue et al. ..... 271/10.12
5,443,251 A * 8/1995 Kan et al. ..... 271/16
5,485,991 A * 1/1996 Hirano et al. ..... 271/121
6,000,689 A * 12/1999 Furuki et al. ..... 271/10.11
6,217,017 B1 * 4/2001 Yamazaki ..... 271/121
6,382,621 B1 * 5/2002 Inoue et al. ..... 271/120
2003/0132570 A1 * 7/2003 Park ..... 271/167

FOREIGN PATENT DOCUMENTS

JP 4-66430 * 3/1992
JP 11-246068 9/1999
JP 2001-233473 8/2001

* cited by examiner

*Primary Examiner*—Patrick Mackey
*Assistant Examiner*—Thomas Morrison
(74) *Attorney, Agent, or Firm*—Staas & Halsey LLP

(57) ABSTRACT

An apparatus for and method of preventing paper double feeding in a paper feeding unit of a printer include a stripper which is installed to be inclined at a predetermined angle and attached to at least one front side of a plurality of paper guides, a lever which is installed at a rear side of the stripper and has a contact surface with paper transferred by a pickup roller, and a lever shaking unit which shakes the lever so that the contact surface intermittently contacts a back side of the paper transferred by the pickup roller. The method includes applying a first paper feeding resistance force to a first sheet of paper which is picked-up by the pickup roller and transferred into the printer, and intermittently applying a second paper feeding resistance to a rear side of a second sheet of paper.

23 Claims, 6 Drawing Sheets

APPARATUS FOR AND METHOD OF PREVENTING PAPER DOUBLE FEEDING IN PRINTER

CROSS-REFERENCE TO RELATED APPLICATIONS

This application claims the priority of Korean Patent Application No. 2002-49210, filed on Aug. 20, 2002, in the Korean Intellectual Property Office, the disclosure of which is incorporated herein in its entirety by reference.

BACKGROUND OF THE INVENTION

1. Field of the Invention

The present invention relates to a printer, and more particularly, to an apparatus for and method of preventing paper double feeding in a paper feeding unit of a printer.

2. Description of the Related Art

In general, a printer or a copier includes a paper feeding unit which receives a plurality of sheets of paper and sequentially feeds the received sheets of paper.

FIG. 1 is a perspective view of a paper feeding unit of a printer employing a conventional apparatus for preventing paper double feeding, FIG. 2 is a side view schematically illustrating the paper feeding unit of the printer to explain an operation of the conventional apparatus shown in FIG. 1, and FIG. 3 is an enlarged view illustrating a front end of a sheet of paper fed in the apparatus of FIG. 2.

Referring to FIGS. 1 and 2, the paper feeding unit includes a paper cassette 20 which is installed to be detachably attached to a frame 10 of the printer, and on which a plurality of sheets of paper P are stacked, and a pickup roller 30 installed to be rotated with respect to the frame 10 of the printer and placed on an upper portion of the paper P stacked on the paper cassette 20. The pickup roller 30 is connected to a shaft 44 rotated by a driving motor 42 and to a gear group 46, is supported by a support arm 48 installed to pivot at the frame 10, and contacts the paper P stacked on the paper cassette 20 due to its weight. Also, an outer surface of the pickup roller 30 is formed of a material having a comparatively large friction coefficient so that the pickup roller 30 easily picks up the paper P. The paper feeding unit further includes a paper guide 50, which is fixed on the frame 10 of the printer and is placed at a front end of the paper cassette 20 to guide the paper P transferred into a printing unit of the printer by the pickup roller 30.

The apparatus for preventing the paper double feeding is provided in the paper feeding unit of the printer having the above structure. As shown in FIGS. 1-3, a stripper 52 generally formed of stainless plates or a synthetic material, such as TEFLON, as the apparatus for preventing the paper double feeding, is attached to a front side of the paper guide 50, that is, to a surface of the paper guide which the paper P contacts. The stripper 52 is installed to be inclined at a predetermined angle θ from a horizontal plane, to prevent double feeding of the paper P.

Referring to FIG. 3, if the pickup roller 30 that contacts a first sheet of paper $P_1$ of the paper P stacked in the paper cassette 2 rotates, the first sheet of paper $P_1$ is transferred into the printer by a friction force between the pickup roller 30 and the first sheet of paper $P_1$. In this case, traveling of a second sheet of paper $P_2$ is disturbed by the stripper 52 inclined at a predetermined tilt angle θ, so that only the first sheet of paper $P_1$ is picked-up by the pickup roller 30 and can be transferred into the printer.

A paper feeding force $F_p$ that acts on the first sheet of paper $P_1$ due to the friction force between the pickup roller 30 and the first sheet of paper $P_1$ may be obtained by Equation 1.

$$F_p=\mu_{roll}\times N \quad (1)$$

Here, $\mu_{roll}$ represents a friction coefficient between the pickup roller 30 and the first sheet of paper $P_1$, and N represents a vertical force that acts on the first paper $P_1$ from the pickup roller 30.

Also, a second paper feeding force $F_D$ that acts on the second sheet of paper $P_2$ due to another friction force between the first sheet of paper $P_1$ and the second sheet of paper $P_2$ may be obtained by Equation 2.

$$F_D=\mu_{paper}\times N \quad (2)$$

Here, $\mu_{paper}$ represents another friction coefficient between the sheets of paper P. Meanwhile, a paper feeding resistance force $F_N$ that disturbs feeding of the paper P is generated by the friction force between the paper P and a resistance generated by the stripper 52, and the paper feeding resistance force $F_N$ may be obtained by Equation 3.

$$F_N=\mu_{paper}\times N+F_{stripper} \quad (3)$$

Here, $F_{stripper}$ represents the resistance that acts on the paper P due to the stripper 52. The resistance $F_{stripper}$ generated by the stripper 52 is proportional to the tilt angle θ of the stripper 52.

Likewise, the above-mentioned three forces are generated when the paper P is picked-up by the pickup roller 30 and is transferred into the printer. In order to prevent double feeding and non-picking up of the paper P, the three forces should satisfy the following conditions of Equation 4.

$$F_p>F_N>F_D \quad (4)$$

More specifically, the paper feeding force $F_p$ that acts on the first sheet of paper $P_1$ should be larger than the paper feeding resistance $F_N$, so that the first sheet of paper $P_1$ is picked-up and is transferred into the printer. Accordingly, in order to satisfy the above conditions, the tilt angle θ of the stripper 52 should be properly set. If the tilt angle θ of the stripper 52 is too large, the paper feeding resistance force $F_N$ becomes larger than the paper feeding force $F_p$ such that the first sheet of paper $P_1$ is not picked-up.

Also, in order to prevent double feeding of the second sheet of paper $P_2$ together with the first sheet of paper $P_1$, the paper feeding resistance force $F_N$ should be larger than the paper feeding force $F_D$ that acts on the second sheet of paper $P_2$. Thus, in order to satisfy the above conditions, the tilt angle θ of the stripper 52 is appropriately set.

That is, the stripper 52 as the conventional apparatus for preventing the paper double feeding has the tilt angle θ of about 70 degrees, large enough to satisfy the above-mentioned two conditions.

However, when an adhesive force is generated between the first sheet of paper $P_1$ and the second sheet of paper $P_2$ due to static electricity generated therebetween or an alien substance interposed therebetween, the paper feeding force $F_D$ that acts on the second sheet of paper $P_2$ may be larger than the paper feeding resistance force $F_N$. This is because since the paper feeding resistance force $F_N$ that acts on the second sheet of paper $P_2$ is defined by the friction force between the second sheet of paper $P_2$ and a third sheet of paper $P_3$ and by the resistance $F_{stripper}$ generated by the stripper 52, the paper feeding resistance force $F_N$ remains constant, whereas the adhesive force between the first sheet of paper $P_1$ and the second sheet of paper $P_2$ is added to the paper feeding force $F_D$ that acts on the second sheet of paper $P_2$. In this case, a double feeding phenomenon occurs when the second sheet of paper $P_2$ is transferred into the printer together with the first sheet of paper $P_1$. The double feeding phenomenon may occur in a case of the third paper $P_3$ or another paper thereunder. In this case, three or more sheets of paper are transferred into the printing unit of the printer.

As described above, the friction force or the adhesive force between the sheets of paper P is not always uniform. Thus, in order to prevent the paper double feeding, the tilt angle θ of the stripper 52 should be large. In this case, the paper feeding resistance force $F_N$ may be larger than the paper feeding force $F_P$, so that the first sheet of paper $P_1$ is not picked-up. Thus, the pickup roller 30 is rotated with a larger torque by using the driving motor 42 having a large capacity or controlling a deceleration ratio, so that the paper feeding force $F_P$ increases. In this case, a load on other elements of the paper feeding unit, such as the gear group 46, increases. Thus, these elements wear or break rapidly, and a life span of the elements is reduced.

SUMMARY OF THE INVENTION

The present invention provides an apparatus for and method of preventing paper double feeding in a printer, which can prevent sheets of paper from not being picked-up and double feeding of the sheets of the paper by intermittently applying a friction force to a rear side of paper, which is picked-up by a pickup roller and transferred into the printer.

Additional aspects and advantages of the invention will be set forth in part in the description which follows and, in part, will be obvious from the description, or may be learned by practice of the invention.

According to one aspect of the present invention, an apparatus for preventing paper double feeding in a paper feeding unit of a printer includes a pickup roller which picks up a sheet of paper stacked on a paper cassette and transfers the paper into the printer, and a plurality of paper guides which are installed on a front portion of the paper cassette and guide the paper transferred by the pickup roller. The apparatus includes a stripper which is installed to be inclined at a predetermined angle with respect to the paper and attached to at least one front side of the paper guides, a lever which is installed at a rear side of the stripper and has a contact surface contacting the paper transferred by the pickup roller, and a lever shaking unit which shakes the lever to intermittently contact a rear (lower) side of the paper transferred by the pickup roller. A friction force is intermittently applied to the rear side of the paper such that double feeding of the paper is prevented.

It is possible that the apparatus further includes a lever shaft which is placed at the rear side of the stripper and rotatably installed in a frame of the printer, and the lever is fixed on the lever shaft, and the lever shaking unit shakes the lever shaft so that the lever is shaken.

It is also possible that an opening groove is formed in an upper portion of the stripper such that the contact surface of the lever contacts the rear side of the paper through the opening groove.

It is also possible that a friction pad is attached to the contact surface of the lever, and the friction pad is formed of rubber.

It is also possible that the lever shaking unit includes a shaking plate fixed on the lever shaft, a cam gear which contacts one side of the shaking plate, rotates, and periodically shakes the shaking plate so that the lever coupled with the lever shaft is shaken, a spring which is installed between the other side of the shaking plate and the frame and applies an elastic force to the shaking plate so that the shaking plate is closely attached to the cam gear, and a driving motor which rotates and drives the cam gear.

It is also possible that at least one cam protrusion is formed on a cam surface to contact the shaking plate. It is possible that three cam protrusions are formed at the same intervals along a circumference of the cam surface to contact the shaking plate.

According to another aspect to the present invention, the lever shaking unit includes a shaking plate fixed on the lever shaft, and a solenoid which is coupled with the shaking plate and periodically shakes the shaking plate so that the lever coupled with the lever shaft is shaken.

According to another aspect of the present invention, a method of preventing paper double feeding is employed in a paper feeding unit of a printer when sheets of paper stacked on a paper cassette are picked-up and are transferred into the printer one by one. The method includes applying a first paper feeding resistance force to the sheet(s) of paper which is picked-up by a pickup roller and transferred into the printer, and intermittently applying a second paper feeding resistance force to a rear side of the sheet(s) of paper. Here, it is possible that the first paper feeding resistance force includes a resistance force generated by a stripper which is installed to be inclined at a predetermined angle on a paper path, wherein the resistance force is smaller than a first paper feeding force applied to a first sheet of paper by the pickup roller, and is larger than a second paper feeding force applied to a second sheet of paper due to a friction force between the sheets of paper.

It is also possible that the second paper feeding resistance force includes a second friction force intermittently applied to the rear side of the sheet(s) of paper by a lever which is installed to be shaken on the paper path, wherein the second friction force and is larger than the first paper feeding resistance.

According to the present invention, the second friction force is intermittently applied to the rear side of paper by the lever such that double feeding and non-picking-up of the paper are prevented.

According to another aspect of the present invention, an apparatus for preventing paper double feeding in a paper feeding unit of a printer includes a frame, a pickup roller which picks up paper stacked on a paper cassette and transfers the paper into the printer, and a plurality of paper guides which are installed at a portion of the paper cassette and guide the paper transferred by the pickup roller in a paper feeding path. The apparatus further includes a stripper disposed on the paper feeding path, fixedly installed on the frame to be inclined at a predetermined angle with respect to the paper stacked on the paper cassette, and contacting the paper transferred by the pickup roller to apply a first paper feeding resistance force to the paper, and a lever disposed on the paper feeding path, movably installed on the frame, and having a contact surface contacting the paper transferred by the pickup roller to apply a second paper feeding resistance force to the paper.

BRIEF DESCRIPTION OF THE DRAWINGS

These and/or other aspects and advantages of the invention will become apparent and more readily appreciated from the following description of the preferred embodiments, taken in conjunction with the accompanying drawing; of which.

DETAILED DESCRIPTION OF THE PREFERRED EMBODIMENTS

Figure 1:
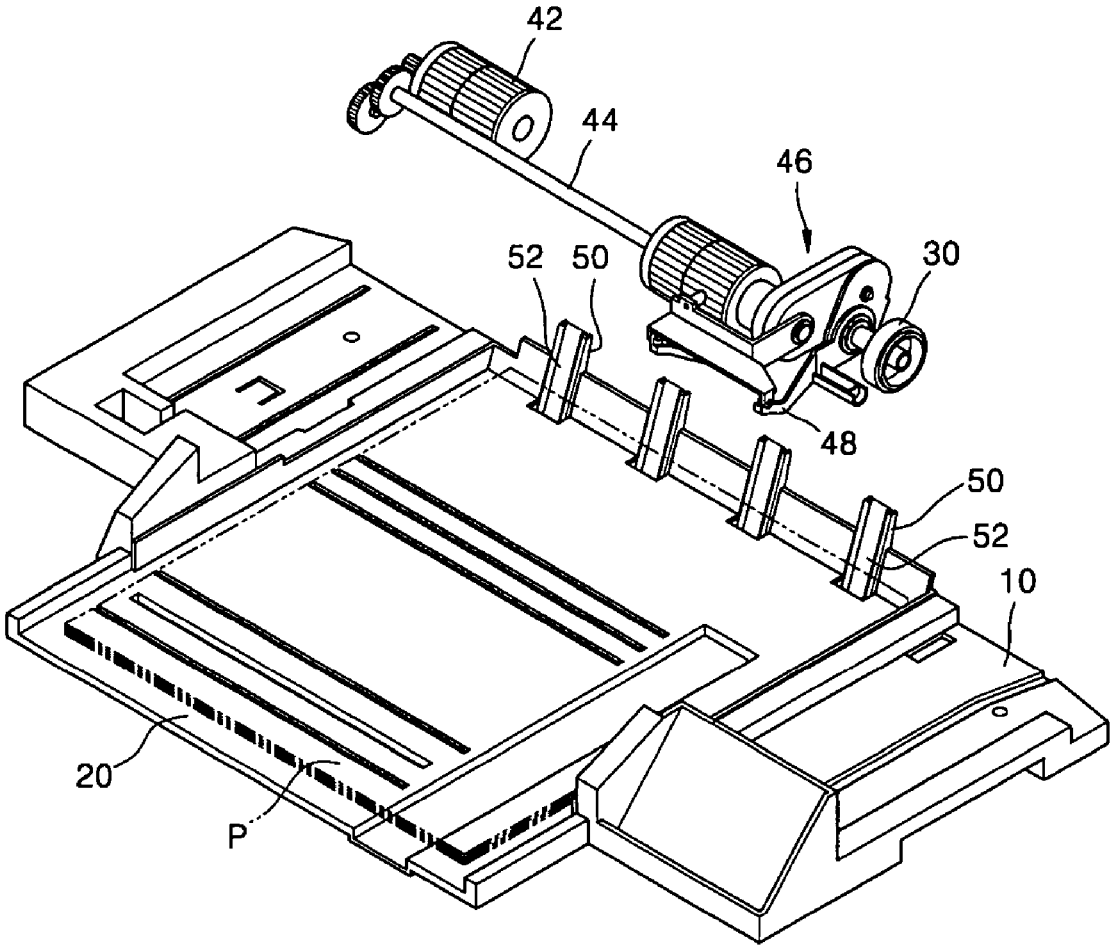
FIG. 1 (PRIOR ART)
FIG. 1 is a perspective view of a paper feeding unit of a printer employing a conventional apparatus for preventing paper double feeding.
Figure 2:
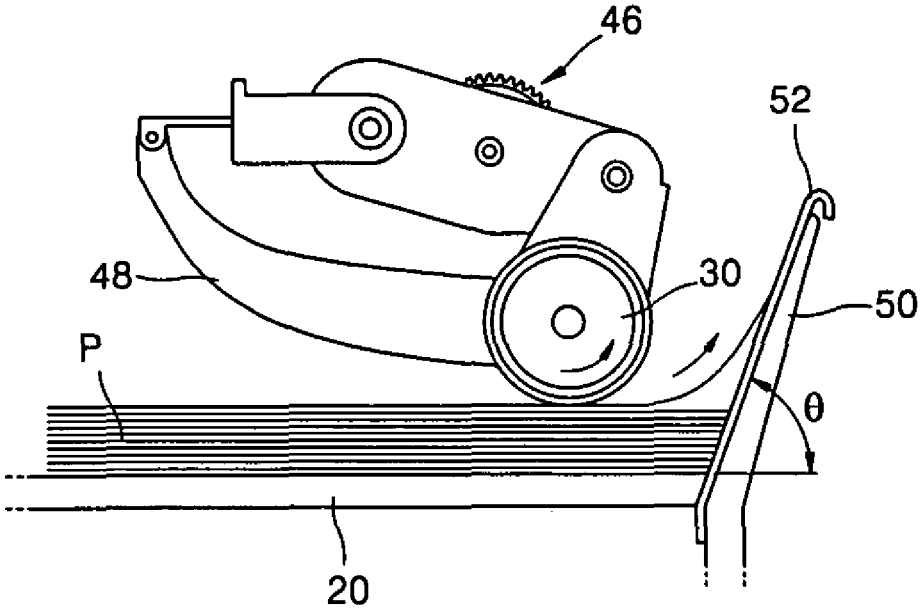
FIG. 2 (PRIOR ART)
FIG. 2 is a side view schematically illustrating the paper feeding unit of the printer to explain an operation of the conventional apparatus of FIG. 1.
Figure 3:
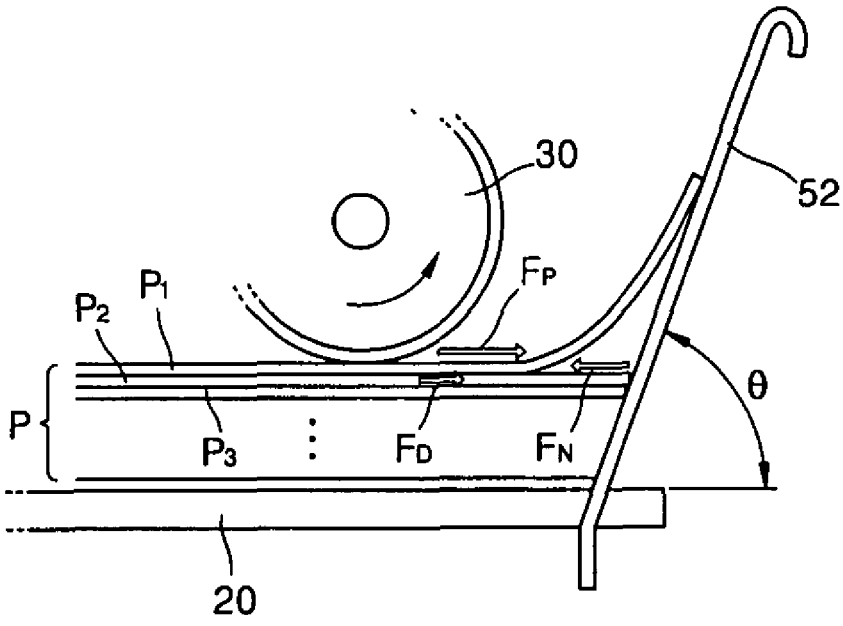
FIG. 3 (PRIOR ART)
FIG. 3 is an enlarged view illustrating a front end of paper fed in the apparatus of FIG. 2.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, the present invention will be described in detail by describing preferred embodiments of the invention with reference to the accompanying drawings.

Figure 4:
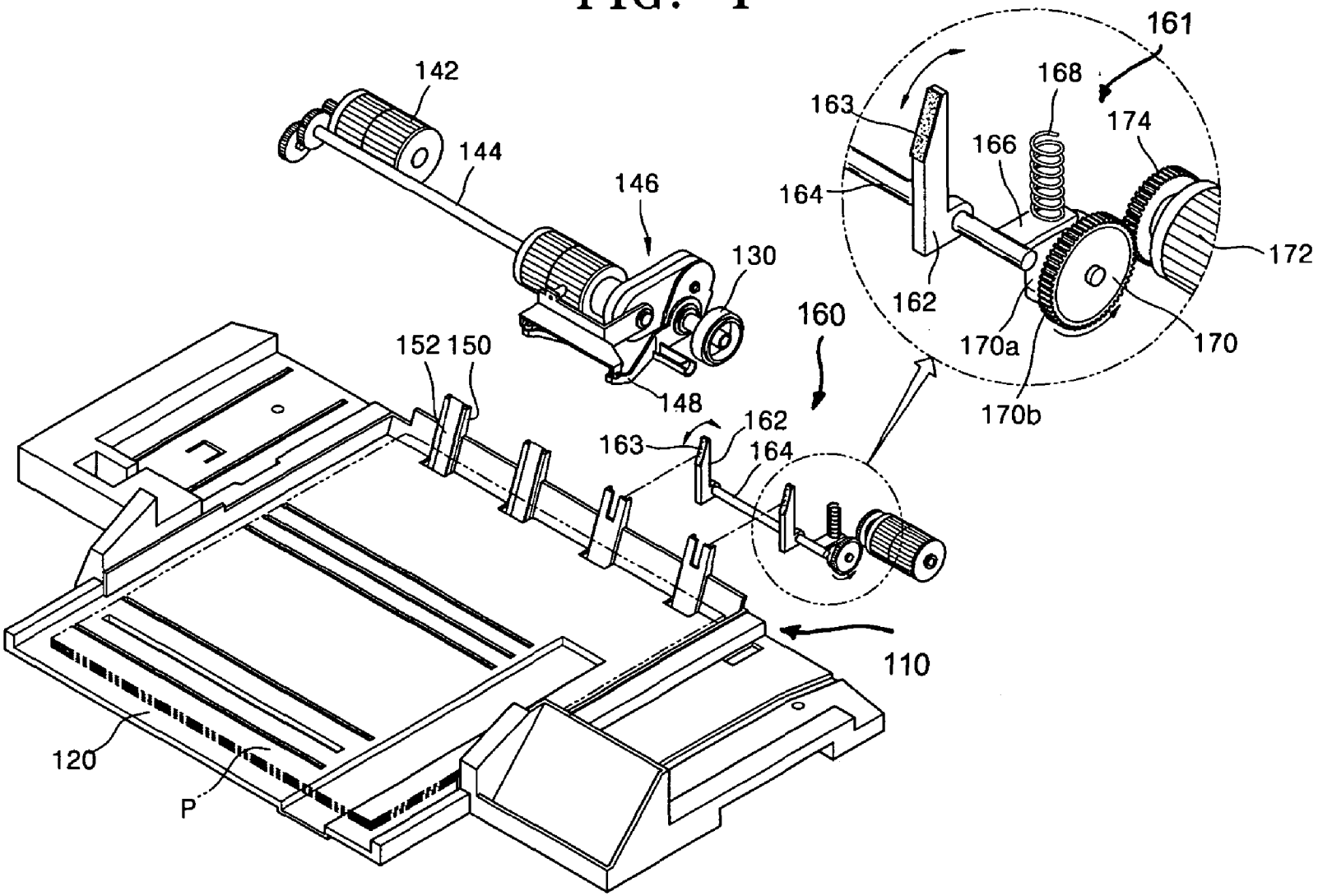
FIG. 4 is an exploded perspective view of a paper feeding unit of a printer employing an apparatus for preventing paper double feeding according to an embodiment of the present invention.
Figure 5:
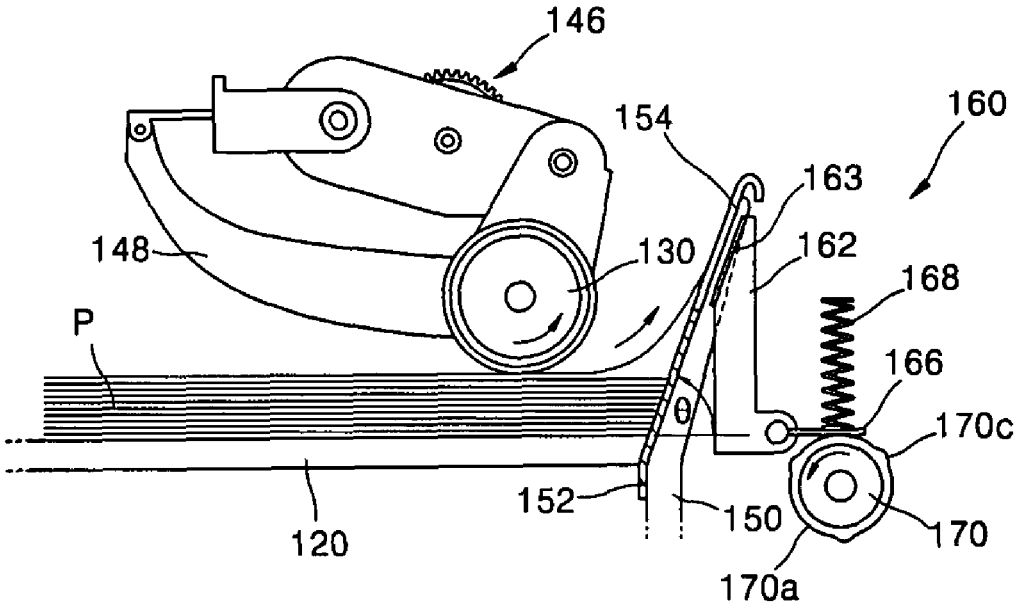
FIG. 5 is a side view schematically illustrating the apparatus of FIG. 4.

FIG. 4 is an exploded perspective view of a paper feeding unit of a printer employing an apparatus 160 for preventing paper double feeding according to an embodiment of the present invention, and FIG. 5 is a side view schematically illustrating the apparatus 160 shown in FIG. 4.

Referring to FIGS. 4 and 5, a printer includes a paper feeding unit which feeds the printer with a plurality of sheets of paper P stacked in a paper cassette 120 installed to be detachably attached to a frame 110 of the printer. The paper feeding unit includes a pickup roller 130 which picks up a sheet of paper P stacked in the paper cassette 120 and transfers the paper P into the printer, and a plurality of paper guides 150 which are installed at a front portion of the paper cassette 120 and guide the paper P transferred by the pickup roller 130. The pickup roller 130 is rotatably installed on the frame 110 of the printer to be placed on an upper portion of the paper P stacked on the paper cassette 120. The pickup roller 130 is supported by a support arm 148 pivotably installed on the frame 110 of the printer and contacts the paper P stacked on the paper cassette 120 due to its weight. An outer surface of the pickup roller 130 is formed of a material having a comparatively large friction coefficient so that the pickup roller 130 easily picks up the paper P. In order to rotate the pickup roller 130, a driving motor 142, a shaft 144 rotated by the driving motor 142, and a gear group 146 which connects the shaft 144 to the pickup roller 130 are provided.

The apparatus 160 for preventing paper double feeding is employed in the paper feeding unit of the printer and prevents two or more sheets of the paper P from being picked up to overlap on the paper feeding unit and being simultaneously transferred into the printer. The apparatus 160 for preventing paper double feeding includes a stripper 152 attached to at least one front side of the paper guides 150, one or more levers 162 installed to be shaken on a rear side of the stripper 152, and a lever shaking unit 161 which shakes the levers 162 to intermittently contact a rear (lower) side of the paper P transferred by the pickup roller 130.

The stripper 152 is attached to the at least one front side of the paper guides 150, that is, to a surface of the paper guide 150 facing the paper P. It is possible that the stripper 152 may be attached to each of the paper guides 150. The stripper 152 is formed of stainless plates or a synthetic material such as TEFLON, and is installed on the surface of the paper guide 150 at a predetermined angle θ from a horizontal plane, to prevent double feeding of the paper P. As described above, the stripper 152 generates a resistance force $F_{stripper}$ that disturbs a transfer of the paper P. The resistance force $F_{stripper}$ and a friction force between the sheets of paper P form a paper feeding resistance force $F_N$ that disturbs paper feeding as shown by Equation 3. In the present invention, the tilt angle θ of the stripper 152 is less than about 70 degrees to prevent the paper P from not being picked-up by the excessive resistance force $F_{stripper}$ generated from the stripper 152. The tile angle θ of the stripper 152 may be smaller than 70 degrees.

The levers 162 are installed at the rear side of the stripper 152 and are periodically shaken by the lever shaking unit 161. The levers 162 having the same number as the number of the strippers 152 may be installed. However, as shown in FIGS. 4 and 5, it is possible that only one or two levers may be installed at the rear side of the stripper 152 adjacent to the pickup roller 130 to reduce spaces where the levers 162 are to be installed, or a driving force. In addition, each of the levers 162 has a contact surface that contacts the paper P transferred by the pickup roller 130. A friction pad 163 having a comparatively large friction coefficient is attached to the contact surface of each of the levers 162, and thus a larger friction force can be applied to the paper P. A rubber material which can be generally, easily obtained and has a certain shock-absorbing property not to damage the paper P is used as the friction pad 163. Also, an opening groove 154 is formed on an upper portion of the stripper 152 so that the friction pad 163 attached to the contact surface of each of the levers 162 contacts the rear side of the paper P through the opening groove 154.

As described above, the levers 162 are periodically shaken by the lever shaking unit 161 such that the friction pad 163 intermittently contacts the rear side of the paper P transferred into the printer by the pickup roller 130 through the opening groove 154. Thus, another friction force is intermittently applied to the paper P by the friction pad 163 of the levers 162 such that the paper feeding resistance force $F_N$ that acts on the paper P periodically increases. That is, when the levers 162 are shaken with respect to the paper P, and the friction pad 163 contacts the paper P, the paper feeding resistance force $F_N$ that acts on the paper P may be expressed by Equation 5.

$$F_N = \mu_{paper} \times N + F_{stripper} + F_L \tag{5}$$

Here, $F_L$ represents another friction force that acts on the paper P due to the levers 162. In comparison with the paper feeding resistance force given in Equation 3 for a conventional apparatus for preventing paper double feeding, the paper feeding resistance force $F_N$ according to an embodiment of the present invention periodically increases by as much as another friction force $F_L$ that acts on the paper P due to the levers 162. Effects thereof will be described in detail later.

Meanwhile, the apparatus 160 for preventing paper double feeding further includes a lever shaft 164, which is arranged on the rear side of the stripper 152 and is rotatably installed on the frame 110 of the printer. In this case, the levers 162 are fixed on the lever shaft 164, and the lever shaking unit 161 shakes the lever shaft 164 so that the levers 162 are shaken. The lever shaking unit 161 may directly shake the lever 162. However, when two or more levers 162 are installed, two or more lever shaking units should be installed. When the lever shaft 164 is provided as described above, only one lever shaking unit can simultaneously shake the levers 162.

The lever shaking unit 161 serves to shake the lever 162 so that the friction pad 163 intermittently contacts the rear side of the paper P transferred by the pickup roller 130. For this purpose, the lever shaking unit 161 includes a shaking plate 166, and a shaker. In this embodiment, the shaker includes a cam gear 170, a compression coil spring 168, and a lever driving motor 172.

The shaking plate 166 is fixed at one side of the lever shaft 164 and extends in a direction perpendicular to a longitudinal direction of the lever shaft 164.

The cam gear 170 is installed to contact a first side of the shaking plate 166, i.e., a bottom surface of the shaking plate 166. A cam surface 170*a* that contacts the shaking plate 166, and a gear portion 170*b* engaged with a driving gear 174 of the lever driving motor 172 are formed on an outer surface of the cam gear 170. The cam gear 170 is rotated by the lever driving motor 172, interferes the shaking plate 166 and periodically shakes the shaking plate 166. As such, the levers 162 fixed on the lever shaft 164 is also shaken. For this purpose, at least one cam protrusion 170*c* is formed on the cam surface 170*a*. The number of the cam protrusions 170*c* may be properly set by considering a shaking period of the levers 162 and a deceleration ratio of the lever driving motor 172. That is, when the deceleration ratio of the lever driving motor 172 is reduced by increasing a diameter of the driving gear 174 of the lever driving motor 172, a rotation speed of the cam gear 170 becomes larger, and thus the levers 162 can be shaken at a first period even though only one cam protrusion 170*c* is formed on the cam surface 170*a*. Meanwhile, when the deceleration ratio of the lever driving motor 172 is increased by reducing the diameter of the driving gear 174, the rotation speed of the cam gear 170 becomes smaller, but a plurality of the cam protrusions 170*c* are formed such that the levers 162 are shaken at a second period. In the latter case, the cam gear 170 generates a sufficient torque even though the lever driving motor 172 having a smaller capacity is used. Thus, three cam protrusions 170*c* are formed at the same intervals along an circumference of the cam surface 170*a* as shown in FIG. 5.

The compression coil spring 168 is installed at a second side of the shaking plate 166, i.e., on an upper portion of the shaking plate 166, thereby applying an elastic force to the shaking plate 166 so that the shaking plate 166 is closely attached to the cam surface 170*a* of the cam gear 170. The shaking plate 166 is always closely attached to the cam surface 170*a* of the cam gear 170 by the compression coil spring 168 and thus shakes by the rotation of the cam gear 170. Meanwhile, the compression coil spring 168 may be replaced with a leaf spring which can perform the same function as the compression coil spring 168. The lever driving motor 172 serves to rotate and drive the cam gear 170 as described above.

Meanwhile, the lever shaking unit 161 may include a solenoid (not shown) instead of the compression coil spring 168, the cam gear 170, and the lever driving motor 172. Thus, in this embodiment, the shaker includes the solenoid. The solenoid is coupled with the shaking plate 166 and periodically and directly shakes the shaking plate 166 so that the levers 162 coupled with the lever shaft 164 are shaken.

Figure 6:
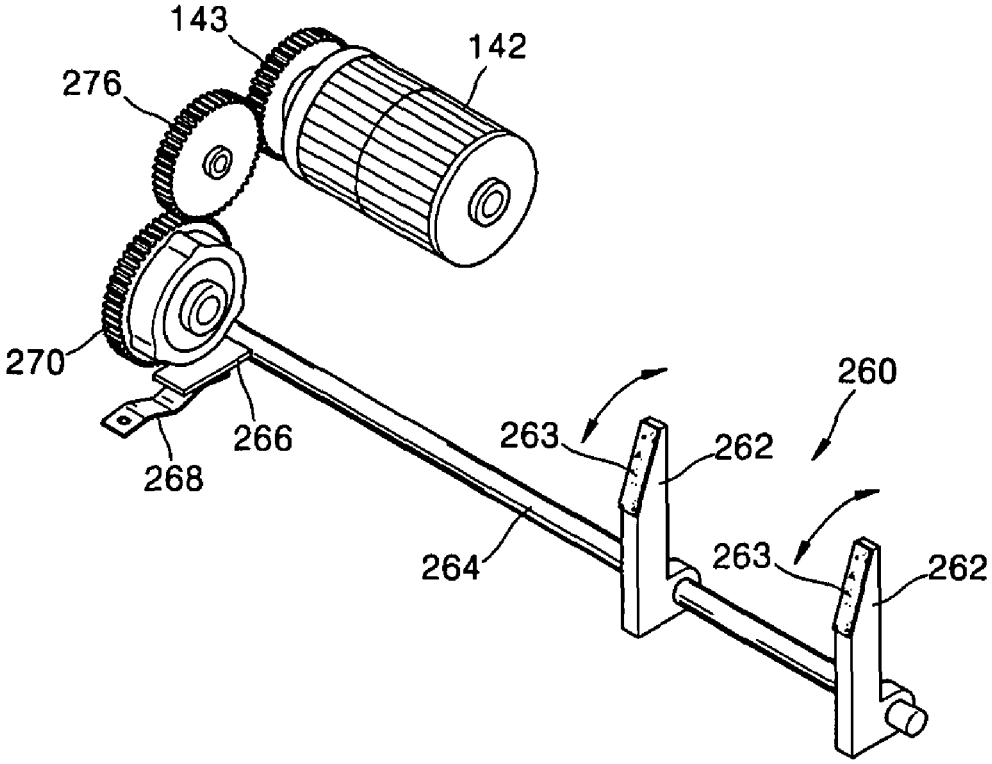
FIG. 6 is a perspective view of an apparatus for preventing paper double feeding, according to another embodiment of the present invention of FIG. 4.

FIG. 6 is a perspective view of an apparatus 260 for preventing paper double feeding according to another embodiment of the present invention.

The apparatus 260 for preventing paper double feeding shown in FIG. 6, like the above-mentioned apparatus (160 of FIG. 4) for preventing paper double feeding, includes one or more levers 262 to which a friction pad 263 is attached, and a lever shaft 264 with which the levers 262 are coupled. Also, a shaking plate 266 is fixed on the lever shaft 266, a cam gear 270 is closely rotatably attached to a first side of the shaking plate 266, and a leaf spring 268 applies an elastic force to a second side of the shaking plate 266 so that the shaking plate 266 is closely attached to the cam gear 270. The leaf spring 268 may be replaced with a compression coil spring as described above. In the apparatus 260 shown in FIG. 6, the cam gear 270 is rotated and driven by the pickup driving motor 142 which rotates and drives the pickup roller 130 shown in FIG. 4. That is, the pickup driving motor 142 is commonly used to rotate and drive the pickup roller (130 of FIG. 4) and the cam gear 270. Thus, according to the apparatus 260 for preventing paper double feeding of FIG. 6, an additional driving motor for driving the cam gear 270 is unnecessary.

Meanwhile, reference numerals 143 and 276 denote a driving gear and an intermediate gear which connects the driving gear 143 to the cam gear 270, respectively.

Hereinafter, an operation of the apparatus 161, 260 for preventing paper double feeding having the above structure will be described.

Figure 7:
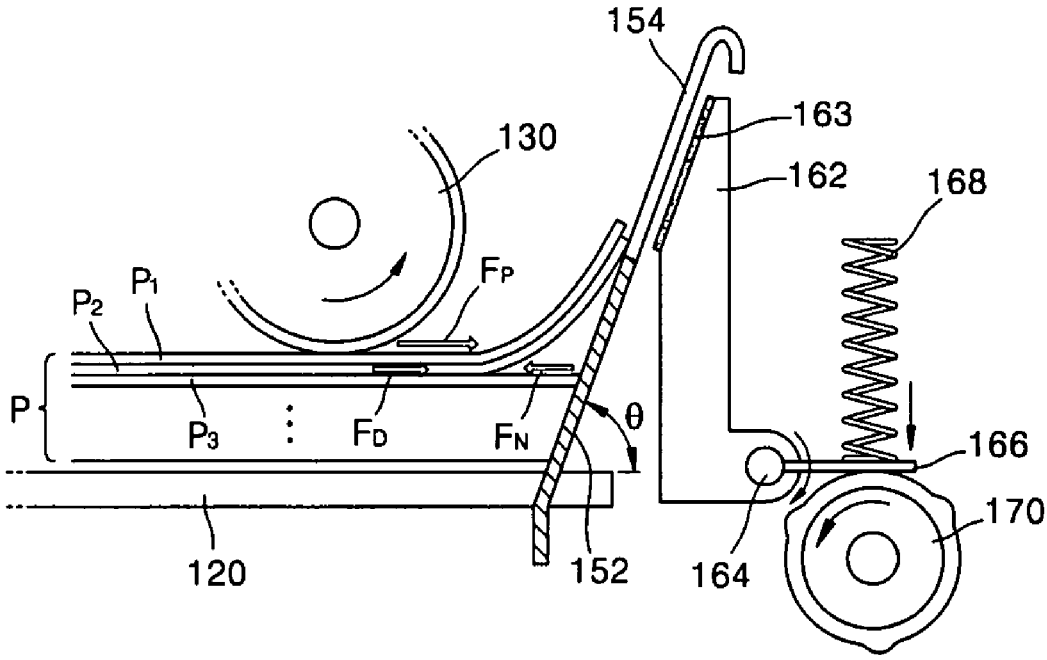
FIGS. 7 and 8 illustrate a first case where a lever does not contact paper, and a second case where the lever contacts the paper, respectively, to explain an operation of the apparatus of FIG. 4.
Figure 8:
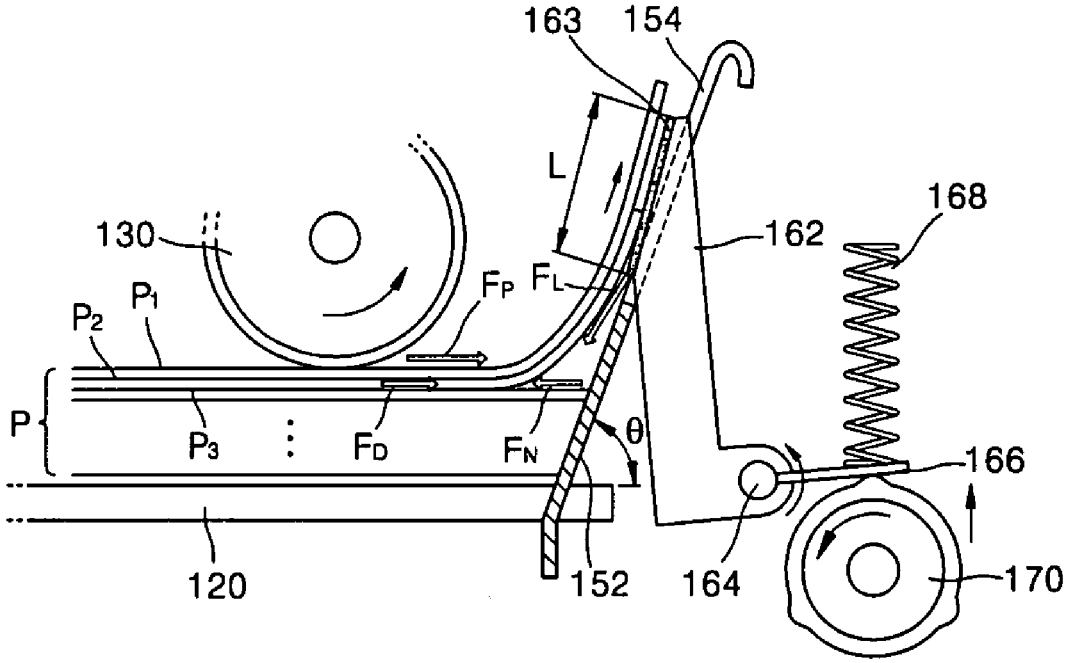
Figure 9:
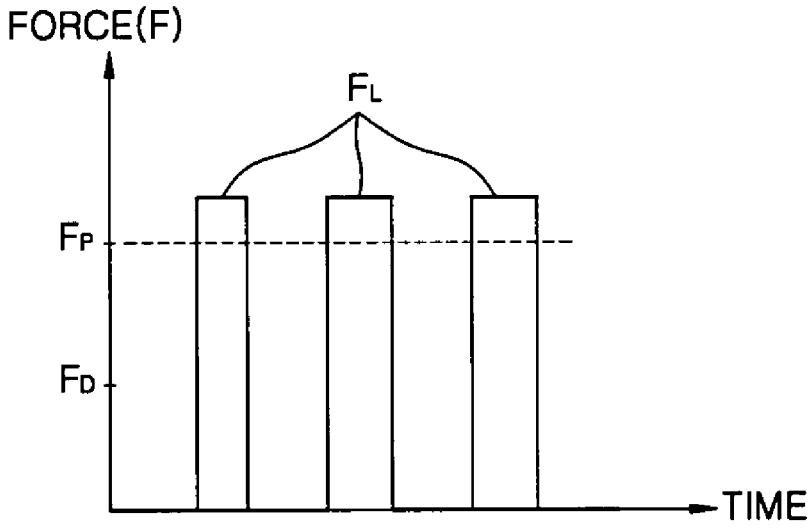
FIG. 9 is a graph illustrating a relationship between a friction force applied to the paper by the lever and other forces in the apparatus of FIG. 4.

FIGS. 7 and 8 illustrate a first case where a lever does not contact the paper, and a second case where the lever contacts the paper, respectively, to explain the operation of the apparatus 161, 260 for preventing paper double feeding of FIG. 4 or FIG. 6, and FIG. 9 is a graph illustrating a relationship between the another friction force applied to the paper by the levers 162, 262 and other forces according to the present invention. Here, the same reference numerals as those in FIGS. 1 through 6 denote the same elements.

Referring to FIG. 7, if the pickup roller 130 which contacts a first sheet of paper $P_1$ of a plurality of sheets of paper P stacked in the paper cassette 120 is rotated, the first paper $P_1$ is transferred into the printer using a paper feeding force $F_P$ generated by the friction force between the pickup roller 130 and the first paper $P_1$. In this case, in order to prevent the first paper $P_1$ from not being picked up, as described above, the tilt angle θ of the stripper 152 is set to be smaller than about 70 degrees. In addition, the shaking plate 166 pivots clockwise by the elastic force of the compression coil spring 168 such that the friction pad 163 is placed behind the opening groove 154 of the stripper 152 and the levers 162 do not disturb traveling of the first paper $P_1$. Meanwhile, even though the levers 162 pivot counterclockwise, and the friction pad 163 is projected forward the opening groove 154, traveling of the first sheet of paper $P_1$ is not disturbed by the friction pad 163 until a front end of the first paper $P_1$ reaches the friction pad 163.

Thus, the paper feeding resistance force $F_N$ that acts on the first paper $P_1$ is smaller than the paper feeding force $F_P$ that acts on the first paper $P_1$ until the front end of the first sheet of paper $P_1$ contacts the friction pad 163 of the levers 162 such that the first paper $P_1$ is prevented from not being picked up.

Meanwhile, as shown in Equations 2 and 3, the paper feeding force $F_P$ that acts on a second sheet of paper $P_2$ is generally smaller than the paper feeding resistance force $F_N$ such that traveling of the second sheet of paper $P_2$ is disturbed by the levers 162.

However, when an adhesive force occurs between the first sheet of paper $P_1$ and the second paper $P_2$ by static electricity generated between the first sheet of paper $P_1$ and the second sheet of paper $P_2$ or an a foreign substance interposed there between, a second paper feeding force $F_D$ that acts on the second sheet of paper $P_2$ may be larger than the paper feeding resistance force $F_N$. In this case, the second sheet of paper $P_2$ is simultaneously transferred with the first sheet of paper $P_1$.

Referring to FIG. 8, if a front end of the second sheet of paper $P_2$ fed with the first sheet of paper $P_1$ reaches the friction pad 163, the front end of the second sheet of paper $P_2$ intermittently contacts the friction pad 163 of the levers 162 shaken by the cam gear 170. In this case, the levers 162 are shaken by the lever shaking unit 161 such that while the front end of the second sheet of paper $P_2$ passes from a lower end to an upper end (interval L) of the friction pad 163, the friction pad 163 periodically at least once, or at least three times contacts a rear side of the second sheet of paper $P_2$. Thus, a friction force is intermittently applied to the second sheet of paper $P_2$ such that the paper feeding resistance force $F_N$ that acts on the second sheet of paper $P_2$ is periodically increased to the friction force $F_L$ that acts on the second sheet of paper $P_2$ due to the levers 162, as shown in Equation 5. In this case, the another. friction force $F_N$ that acts on the rear side of the second sheet of paper $P_2$ due to the levers 162 is larger than the second paper feeding force $F_D$ that acts on the second sheet of paper $P_2$. In particular, the another friction force $F_L$ may be larger than the resistance force $F_{stripper}$ generated by the stripper 152. Thus, the traveling of the second sheet of paper $P_2$ is disturbed by the another friction force $F_L$ from when the second sheet of paper $P_2$ contacts the friction pad 163 such that paper double feeding is prevented.

Meanwhile, a second friction force or the adhesive force between the plurality of sheets of paper P is not uniform, and the second paper feeding force $F_D$ that acts on the second sheet of paper $P_2$ may be almost the same as the first paper feeding force $F_P$ that acts on the first sheet of paper $P_1$. Accordingly, in order to prevent paper double feeding, as shown in FIG. 9, it is possible that the another friction force $F_L$ that acts on the rear side of the second sheet of paper $P_2$ due to the levers 162 is set to be larger than the paper feeding force $F_P$ that acts on the first sheet of paper $P_1$.

However, the another friction force $F_L$ generated by the levers 162 also acts on the first sheet of paper $P_1$ when the first sheet of paper $P_1$ is picked-up and transferred. However, the another friction force $F_L$ intermittently acts on the first sheet of paper $P_1$ for a short time, whereas the paper feeding force $F_P$ generated by the pickup roller 130 continuously acts on the first sheet of paper $P_1$ such that the traveling of the first sheet of paper $P_1$ is not disturbed by the levers 162.

Thus, according to the present invention, when the sheets of paper P are simultaneously fed, the traveling of the second sheet of paper $P_2$ can be effectively disturbed by the lever, and when only one sheet of the paper P is fed, the traveling of the first sheet of paper $P_1$ is not disturbed by the lever.

As described above, in the apparatus for and method of preventing paper double feeding in the printer according to the present invention, the another friction force is intermittently applied to the rear side of the paper double fed (simultaneously fed) by shaking the levers such that the paper double feeding is prevented. In addition, the another friction force generated by the levers is not applied to the picked-up paper when the paper is initially picked-up such that a problem that the paper is not picked-up is prevented. In addition, the another friction force generated by the lever is intermittently applied to the rear side of the paper such that the paper is picked-up by the pickup roller and traveling of the paper transferred into the printer is not disturbed by the levers.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. An apparatus for preventing paper double feeding in a paper feeding unit of a printer having a frame, a pickup roller which picks up sheets of paper stacked on a paper cassette and transfers the paper into the printer, and a plurality of paper guides which are installed at a front portion of the paper cassette and guide the paper transferred by the pickup roller, the apparatus comprising:

a stripper which is installed to be inclined at a predetermined angle with respect to the paper stacked on the paper cassette, and attached to at least one front side of each of the paper guides;

a lever which is installed at a side of the stripper and has a contact surface to contact the paper transferred by the pickup roller; and a lever shaking unit which shakes the lever to intermittently contact a side of the paper transferred by the pickup roller, the lever shaking unit comprising a lever shaft installed on the frame, the lever being connected to the lever shaft, a shaking plate extending from the lever shaft, and a shaker installed on the frame and intermittently shaking the shaking plate to shake the lever;

wherein a friction force is intermittently applied to the side of the paper by the lever, such that double feeding of the paper is prevented and the stripper comprises an opening groove formed on an upper portion of the stripper such that the contact surface of the lever contacts the side of the paper through the opening groove.

2. The apparatus of claim 1, wherein the lever is shaken so that the contact surface periodically at least three times contacts the paper while a front end of the paper passes from a lower end of the contact surface to an upper end of the contact surface.

3. The apparatus of claim 1, wherein:

the stripper comprises a plurality of sub-strippers; and the lever comprises a plurality of sub-levers having the same number as the sub-strippers.

4. The apparatus of claim 1, wherein the friction force intermittently applied to the side of the paper by the lever is larger than a resistance applied to the paper by the stripper.

5. The apparatus of claim 1, wherein the lever comprises:

a friction pad attached to the contact surface of the lever.

6. The apparatus of claim 5, wherein the friction pad is formed of a rubber material.

7. An apparatus for preventing paper double feeding in a paper feeding unit of a printer having a frame, a pickup roller which picks up sheets of paper stacked on a paper cassette and transfers the paper into the printer, and a plurality of paper guides which are installed at a front portion of the paper cassette and guide the paper transferred by the pickup roller, the apparatus comprising:

a stripper which is installed to be inclined at a predetermined angle with respect to the paper stacked on the paper cassette, and attached to at least one front side of each of the paper guides;

a lever which is installed at a side of the stripper and has a contact surface to contact the paper transferred by the pickup roller;

a lever shaking unit which shakes the lever to intermittently contact a side of the paper transferred by the pickup roller; and a lever shaft which is placed at the side of the stripper and rotatably installed on the frame of the printer, wherein the lever is fixed on the lever shaft, and the lever shaking unit shakes the lever shaft so that the lever is shaken, wherein a friction force is intermittently applied to the side of the paper by the lever, such that double feeding of the paper is prevented, the lever shaking unit comprises:

a shaking plate fixed on the lever shaft, a cam gear which contacts a first side of the shaking plate, rotates, and periodically shakes the shaking plate so that the lever coupled with the lever shaft is shaken, an elastic member which is installed at a second side of the shaking plate and applies an elastic force to the shaking plate so that the shaking plate is closely attached to the cam gear, and a driving motor which rotates and drives the cam gear, the driving motor rotates and drives the pickup roller, and the stripper comprises an opening groove formed on an upper portion of the stripper such that the contact surface of the lever contacts the side of the paper through the opening groove.

8. The apparatus of claim 7, wherein the elastic member comprises:

a compression coil spring.

9. The apparatus of claim 7, wherein the elastic member comprises:

a leaf spring.

10. The apparatus of claim 7, wherein:

the cam gear comprises a cam surface; and the lever shaking unit comprises at least one cam protrusion formed on the cam surface that contacts the shaking plate.

11. An apparatus for preventing paper double feeding in a paper feeding unit of a printer having a frame, a pickup roller which picks up sheets of paper stacked on a paper cassette and transfers the paper into the printer, and a plurality of paper guides which are installed at a front portion of the paper cassette and guide the paper transferred by the pickup roller, the apparatus comprising:

a stripper, which is installed to be inclined at a predetermined angle with respect to the paper stacked on the paper cassette, and attached to at least one front side of each of the paper guides;

a lever, which is installed at a side of the stripper and has a contact surface to contact the paper transferred by the pickup roller;

a lever shaking unit, which shakes the lever to intermittently contact a side of the paper transferred by the pickup roller; and a lever shaft, which is placed at the side of the stripper and rotatably installed on the frame of the printer, wherein the lever is fixed on the lever shaft, and the lever shaking unit shakes the lever shaft so that the lever is shaken, wherein a friction force is intermittently applied to the side of the paper by the lever, such that double feeding of the paper is prevented, and the lever shaking unit comprises:

a shaking plate fixed on the lever shaft, a cam gear, which contacts a first side of the shaking plate, rotates, and periodically shakes the shaking plate so that the lever coupled with the lever shaft is shaken, the cam gear comprising a cam surface, an elastic member, which is installed at a second side of the shaking plate and applies an elastic force to the shaking plate so that the shaking plate is closely attached to the cam gear, at least one cam protrusion formed on the cam surface that contacts the shaking plate, the at least one cam protrusion comprising three sub-cam protrusions formed at the same intervals along a circumference of the cam surface that contacts the shaking plate, and a driving motor, which rotates and drives the cam gear.

12. An apparatus for preventing paper double feeding in a paper feeding unit of a printer having a frame, a pickup roller which picks up sheets of paper stacked on a paper cassette and transfers the paper into the printer, and a plurality of paper guides which are installed at a front portion of the paper cassette and guide the paper transferred by the pickup roller, the apparatus comprising:

a stripper which is installed to be inclined at a predetermined angle with respect to the paper stacked on the paper cassette, and attached to at least one front side of each of the paper guides;

a lever which is installed at a side of the stripper and has a contact surface to contact the paper transferred by the pickup roller;

a lever shaking unit which shakes the lever to intermittently contact a side of the paper transferred by the pickup roller; and a lever shaft which is placed at the side of the stripper and rotatably installed on the frame of the printer, wherein the lever is fixed on the lever shaft, and the lever shaking unit shakes the lever shaft so that the lever is shaken, wherein a friction force is intermittently applied to the side of the paper by the lever, such that double feeding of the paper is prevented, the lever shaking unit comprises:

a shaking plate fixed on the lever shaft, and a shaker, which is coupled with the shaking plate and periodically shakes the shaking plate so that the lever coupled with the lever shaft is shaken, and the stripper comprises an opening groove formed on an upper portion of the stripper such that the contact surface of the lever contacts the side of the paper through the opening groove.

13. An apparatus for preventing paper double feeding in a paper feeding unit of a printer having a frame, a pickup roller which picks up paper stacked on a paper cassette and transfers the paper into the printer, and a plurality of paper guides which are installed at a portion of the paper cassette and guide the paper transferred by the pickup roller in a paper feeding path, the apparatus comprising:

a stripper disposed on the paper feeding path, fixedly installed on the frame to be inclined at a predetermined angle with respect to the paper stacked on the paper cassette, and contacting the paper transferred by the pickup roller to apply a first paper feeding resistance force to the paper;

a lever shaking unit, comprising a lever shaft movably installed on the frame, a plate extending from the lever shaft, and a shaker, selectively contacting the plate to rotate the lever shaft; and a lever disposed on the paper feeding path, installed on the shaft, and having a contact surface intermittently contacting the paper transferred by the pickup roller to apply a second paper feeding resistance force to the paper, wherein the stripper comprises another contact surface contacting the paper and an opening formed through the another contact surface, and the contact surface of the lever is disposed in the opening of the another contact surface of the stripper.

14. The apparatus of claim 13, wherein the paper comprises a first paper and a second paper, and the stripper applies the first paper feeding resistance force to the first paper while the contacting surface of the lever applies the second paper feeding resistance force to the second paper.

15. The apparatus of claim 13, wherein the lever selectively contacts the paper while the stripper contacts the paper.

16. The apparatus of claim 13, wherein the lever moves in a direction between a first position to allow the contact surface to contact the paper and a second position to allow the contact surface to be moved away from the paper passing the stripper.

17. The apparatus of claim 13 wherein the lever rotates in a direction perpendicular to the paper feeding direction.

18. The apparatus of claim 13, wherein the contact surface of the lever contacts the paper through the opening.

19. The apparatus of claim 13, wherein the paper comprises a first paper and a second paper, the first paper and the second paper generate a friction force between the first paper and the second paper, and the second paper feeding resistance force is equal to or greater than the friction force.

20. The apparatus of claim 13, wherein the lever shaking unit further comprises:

a resilient member biasing the lever in a first direction.

21. The apparatus of claim 20, wherein the shaft is parallel to a width direction of the paper perpendicular to the paper feeding direction.

22. An apparatus for preventing paper double feeding in a paper feeding unit of a printer having a frame, a pickup roller which picks up paper stacked on a paper cassette and transfers the paper into the printer, and a plurality of paper guides which are installed at a portion of the paper cassette and guide the paper transferred by the pickup roller in a paper feeding path, the apparatus comprising:

a stripper disposed on the paper feeding path, fixedly installed on the frame to be inclined at a predetermined angle with respect to the paper stacked on the paper cassette, and contacting the paper transferred by the pickup roller to apply a first paper feeding resistance force to the paper;

a lever disposed on the paper feeding path, movably installed on the frame, and having a contact surface contacting the paper transferred by the pickup roller to apply a second paper feeding resistance force to the paper; and a single motor rotating the pickup roller and moving the lever with respect to the stripper, wherein the stripper comprises an opening groove formed on an upper portion of the stripper such that the contact surface of the lever contacts a side of the paper through the opening groove.

23. An apparatus for preventing paper double feeding in a paper feeding unit of a printer having a frame, a pickup roller which picks up paper stacked on a paper cassette and transfers the paper into the printer, and a plurality of paper guides which are installed at a portion of the paper cassette and guide the paper transferred by the pickup roller in a paper feeding path, the apparatus comprising:

a stripper fixedly disposed on the paper feeding path to apply a first paper feeding resistance force to the paper fed by the pickup roller;

a lever movably disposed on the paper feeding path to selectively apply a second paper feeding resistance force to the paper fed by the pickup roller, the lever having a contact surface and being installed on a lever shaft rotatably installed on the frame;

a plate extending from the lever shaft; and a shaker controlling the lever by intermittently shaking the plate to move with respect to the paper fed by the pickup roller, to intermittently contact the paper, the stripper comprises an opening groove formed on an upper portion of the stripper such that the contact surface of the lever contacts a side of the paper through the opening groove.

* * * * *